US008810471B2

(12) United States Patent
Kang et al.

(10) Patent No.: US 8,810,471 B2
(45) Date of Patent: Aug. 19, 2014

(54) CIRCULARLY POLARIZED CERAMIC PATCH ANTENNA HAVING EXTENDED GROUND FOR VEHICLE

(75) Inventors: Gi-Cho Kang, Anyang-si (KR); Tae-Byung Park, Anyang-si (KR); Sang-Min Nam, Seoul (KR); Chang-Keun Lee, Ansan-si (KR)

(73) Assignee: Winnercom Co., Ltd., Gimhae (KR)

( * ) Notice: Subject to any disclaimer, the term of this patent is extended or adjusted under 35 U.S.C. 154(b) by 175 days.

(21) Appl. No.: 13/488,657

(22) Filed: Jun. 5, 2012

(65) Prior Publication Data

US 2012/0319917 A1 Dec. 20, 2012

(30) Foreign Application Priority Data

Jun. 15, 2011 (KR) ..... 20-2011-0005306

(51) Int. Cl.
*H01Q 1/38* (2006.01)
*H01Q 1/48* (2006.01)

(52) U.S. Cl.
USPC ..... 343/848; 343/700 MS

(58) Field of Classification Search
USPC ..... 343/700 MS, 711, 713, 846, 848
See application file for complete search history.

(56) References Cited

U.S. PATENT DOCUMENTS

| | | | | |
|---|---|---|---|---|
| 7,253,770 | B2 * | 8/2007 | Yegin et al. | 343/700 MS |
| 7,675,471 | B2 * | 3/2010 | Yegin et al. | 343/711 |
| 8,228,238 | B2 * | 7/2012 | Thiam et al. | 343/700 MS |
| 8,482,466 | B2 * | 7/2013 | Thiam et al. | 343/700 MS |
| 2006/0028382 | A1 * | 2/2006 | Ikeda et al. | 343/713 |

FOREIGN PATENT DOCUMENTS

JP 2007-274317 A 10/2007

OTHER PUBLICATIONS

KIPO Office Action for Korean Patent Application No. 20-2011-0005306 which corresponds to the above-referenced U.S. Application.

* cited by examiner

*Primary Examiner* — Tan Ho
(74) *Attorney, Agent, or Firm* — LRK Patent Law Firm

(57) ABSTRACT

A circularly polarized ceramic patch antenna having an extended ground for a vehicle is provided. The extended ground is formed under a patch antenna, has a predetermined thickness, is formed of a metal conductor having the same shape as the patch antenna, and is electrically connected to a ground plane formed on a board. The thickness of the extended ground is adjusted, so that it is possible to adjust radiation efficiency of the ceramic patch antenna that operates at a specific frequency band. Thus, the ceramic patch antenna has the effect of improving directionality of a radiation pattern formed in a direction parallel to the ground plane, and the effect of reducing a null point caused by a field effect to increase an antenna gain thereof.

10 Claims, 6 Drawing Sheets

| Freq.[MHz] | Avg.[dBi] | Peak[dBi] | Φ[deg] | Null[dBi] | Φ[deg] |
|---|---|---|---|---|---|
| 2332.500 | -3.50 | -1.50 | 54.00 | -12.02 | 142.00 |
| 2338.750 | -3.42 | -1.66 | 204.00 | -10.03 | 140.00 |
| 2345.000 | -3.33 | -1.76 | 210.00 | -7.93 | 144.00 |

| Freq.[MHz] | Avg.[dBi] | Peak[dBi] | Φ[deg] | Null[dBi] | Φ[deg] |
|---|---|---|---|---|---|
| 2332.500 | -2.91 | -1.06 | 200.00 | -7.22 | 142.00 |
| 2338.750 | -3.07 | -1.79 | 200.00 | -6.18 | 144.00 |
| 2345.000 | -3.08 | -1.91 | 266.00 | -5.08 | 138.00 |

| Freq.[MHz] | Avg.[dBi] | Peak[dBi] | Φ[deg] | Null[dBi] | Φ[deg] |
|---|---|---|---|---|---|
| 2332.500 | -0.04 | 2.45 | 230.00 | -7.05 | 142.00 |
| 2338.750 | 0.06 | 2.23 | 216.00 | -5.19 | 144.00 |
| 2345.000 | 0.16 | 2.05 | 212.00 | -3.59 | 142.00 |

| Freq.[MHz] | Avg.[dBi] | Peak[dBi] | Φ[deg] | Null[dBi] | Φ[deg] |
|---|---|---|---|---|---|
| 2332.500 | 0.58 | 2.61 | 208.00 | -2.59 | 142.00 |
| 2338.750 | 0.50 | 2.19 | 202.00 | -10.03 | 140.00 |
| 2345.000 | 0.53 | 1.79 | 198.00 | -7.93 | 144.00 |

CIRCULARLY POLARIZED CERAMIC PATCH ANTENNA HAVING EXTENDED GROUND FOR VEHICLE

BACKGROUND OF THE INVENTION

1. Field of the Invention

The present invention relates, in general, to a circularly polarized ceramic patch antenna having an extended ground for a vehicle, and more particularly to a circularly polarized ceramic patch antenna having an extended ground for a vehicle, in which the extended ground is formed under a patch antenna, has a predetermined thickness, is formed of a metal conductor in a shape that is the same as that of the patch antenna, and is electrically connected to a ground plane formed on a board, thereby reducing a null point to improve radiation efficiency.

2. Description of the Related Art

FIGS. 1 and 2 show schematic and detailed configurations of a ceramic patch antenna 10 for a vehicle installed on a conventional shark fin antenna for a vehicle. As shown in FIGS. 1 and 2, the conventional ceramic patch antenna 10 includes a dielectric 11 formed of ceramic on a board 1 having a feeder circuit and a ground plane of a vehicle antenna, a radiator 12 formed of a quadrilateral metal thin film on the dielectric 11, a ground 13 formed of a metal thin film under the dielectric 11, and a feeder 14 connecting the radiator 12 and the feeder circuit disposed on the board. The conventional ceramic patch antenna for a vehicle is small in size and light in weight, but it has the problem that, since its antenna performance is limited by the occurrence of a null point, its use is restricted to global positioning system (GPS) antennas that do not require high antenna performance.

Thus, there is an urgent need for a technology that in reality has a high degree of applicability and is able to reduce the null point occurring at the ceramic patch antenna for a vehicle to provide various radio communication services such as the reception of digital satellite radio broadcasting.

SUMMARY OF THE INVENTION

Accordingly, the present invention has been made keeping in mind the above problems occurring in the related art, and an object of the present invention is to provide a circularly polarized ceramic patch antenna having an extended ground for a vehicle, in which the extended ground is formed under a patch antenna, has a predetermined thickness, is formed of a metal conductor in the same shape as the patch antenna, and is electrically connected to a ground plane formed on a board, thereby improving the directivity of a radiation pattern formed in a direction parallel to the ground plane to reduce a null point.

In order to achieve the above object, according to an aspect of the present invention, there is provided a circularly polarized ceramic patch antenna having an extended ground for a vehicle, which is disposed on a board having a feeder circuit and a ground plane of a vehicle antenna. The circularly polarized ceramic patch antenna includes: a patch antenna having a dielectric through which a first feeder hole is bored and which is formed of ceramic, a radiator that is formed of a quadrilateral metal thin film, diagonally opposite corners of which are partly chamfered to provide circular polarization, and that is formed on the dielectric, a main ground through which a second feeder hole is bored at a position corresponding to the first feeder hole so as to have a larger diameter than the feeder hole and which is formed of a metal thin film placed under the dielectric, and a feeder that connects the radiator and the feeder circuit on the board through the first and second feeder holes; and an extended ground, through which a third feeder hole is bored so as to correspond to the second feeder hole, which is formed under the patch antenna, which has a predetermined thickness, which is formed of a metal conductor having the same shape as the patch antenna, and which is electrically connected to the ground plane formed on the board.

As described above, the circularly polarized ceramic patch antenna having an extended ground for a vehicle is configured so that the extended ground is formed under a patch antenna, has a predetermined thickness, is formed of a metal conductor having the same shape as the patch antenna, and is electrically connected to a ground plane formed on a board. Also, the thickness of the extended ground can be adjusted, so that it is possible to adjust the radiation efficiency of the ceramic patch antenna that operates at a specific frequency band. Thus, an effect of the ceramic patch antenna is to improve the directionality of a radiation pattern formed in a direction parallel to the ground plane, and another effect is to reduce a null point caused by a field effect so that the antenna gain thereof can be increased.

BRIEF DESCRIPTION OF THE DRAWINGS

The above and other objectives, features and other advantages of the present invention will be more clearly understood from the following detailed description when taken in conjunction with the accompanying drawings, in which.

DETAILED DESCRIPTION OF THE INVENTION

Reference will now be made in greater detail to exemplary embodiments of the invention with reference to the accompanying drawings.

A circularly polarized ceramic patch antenna having an extended ground for a vehicle practiced by the present invention is designed to be disposed on a board having a feeder circuit and a ground plane of an antenna for a vehicle.

Figure 1:
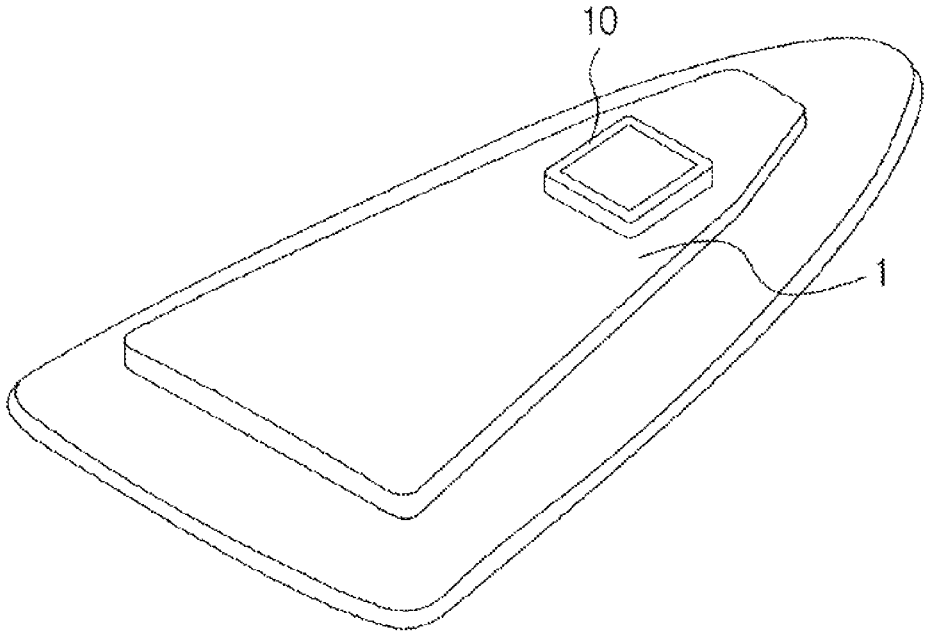
FIG. 1 RELATED ART
FIG. 1 shows a schematic configuration of a ceramic patch antenna for a vehicle installed on a conventional shark fin antenna for a vehicle.
Figure 2:
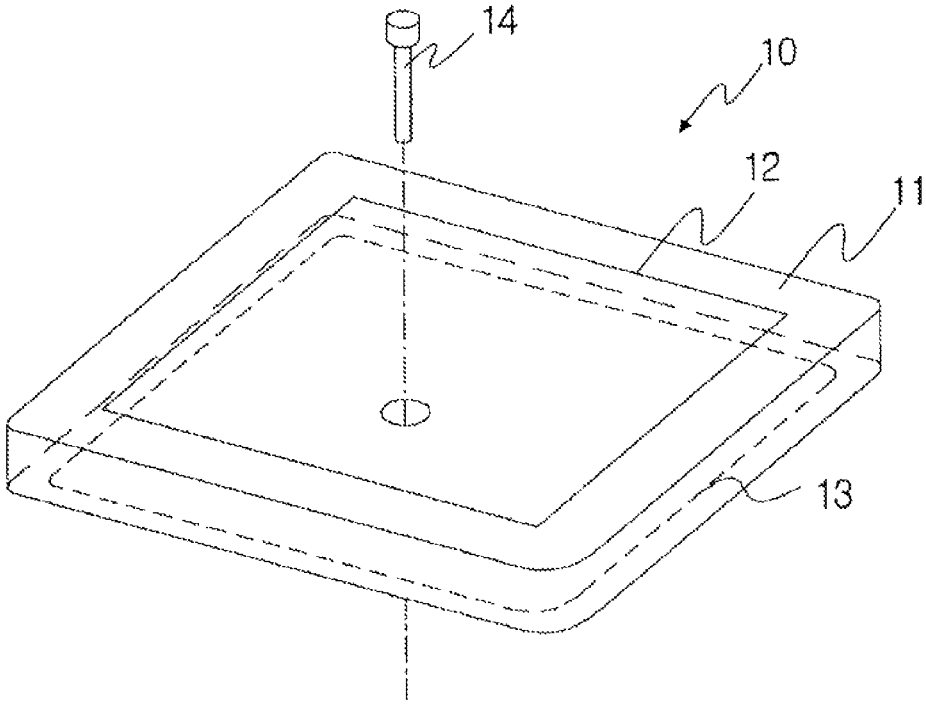
FIG.2 RELATED ART
FIG. 2 shows a detailed configuration of a ceramic patch antenna for a vehicle installed on a conventional shark fin antenna for a vehicle.
Figure 3:
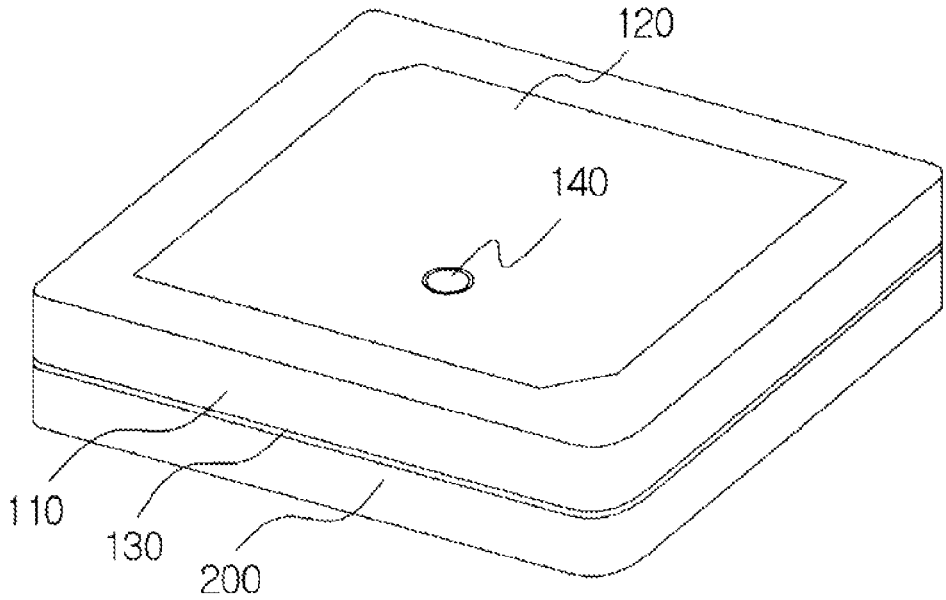
FIG. 3 is a perspective view showing a circularly polarized ceramic patch antenna having an extended ground for a vehicle according to an embodiment of the present invention.

FIG. 3 is a perspective view showing a circularly polarized ceramic patch antenna having an extended ground for a vehicle according to an embodiment of the present invention.

The circularly polarized ceramic patch antenna having an extended ground for a vehicle according to an embodiment of the present invention is disposed on a board having a feeder circuit and a ground plane of a shark fin antenna for a vehicle, and as shown in FIG. 3, includes a patch antenna 100 that has a dielectric 110 formed of ceramic, a radiator 120 formed on the dielectric 110, a main ground 130 formed under the dielectric 110, and a feeder 140 connecting the radiator 120 and the feeder circuit disposed on the board, and an extended ground 200 formed on the patch antenna 100 in a downward direction.

In detail, among the components of the patch antenna 100, the radiator 120 is formed of a quadrilateral metal thin film, opposite corners of which are partly chamfered to provide circular polarization, and the main ground 130 is formed of a metal thin film on a bottom surface of the dielectric 110. The extended ground 200 has a predetermined thickness, and is formed of a metal conductor having the same shape as the patch antenna 100.

Further, the dielectric 110, the main ground 130, and the extended ground 200 drill first, second and third feeder holes 111, 131 and 201, and the feeder 140 for electrical connection with the radiator 120 is inserted into the feeder holes. Thus, the feeder 140 is electrically connected with the radiator 120. Thereby, a feed signal applied from the feeder circuit formed on the board is transmitted to the radiator 120. In this case, the second and third feeder holes 131 and 201 formed in the main ground 130 and the extended ground 200 are preferably greater in diameter than the first feeder hole 111 such that the feeder 140 formed of a rod-like pin can be insulated from the main ground 130 and the extended ground 200.

On the other hand, the extended ground 200 is provided below the patch antenna 100, and interacts with the main ground 130 of the patch antenna 100 by forming an electrical connection with the ground plane formed on the board. Thereby, a null point generated between the radiator 120 of the patch antenna 100 and the ground plane is reduced.

Figure 4:
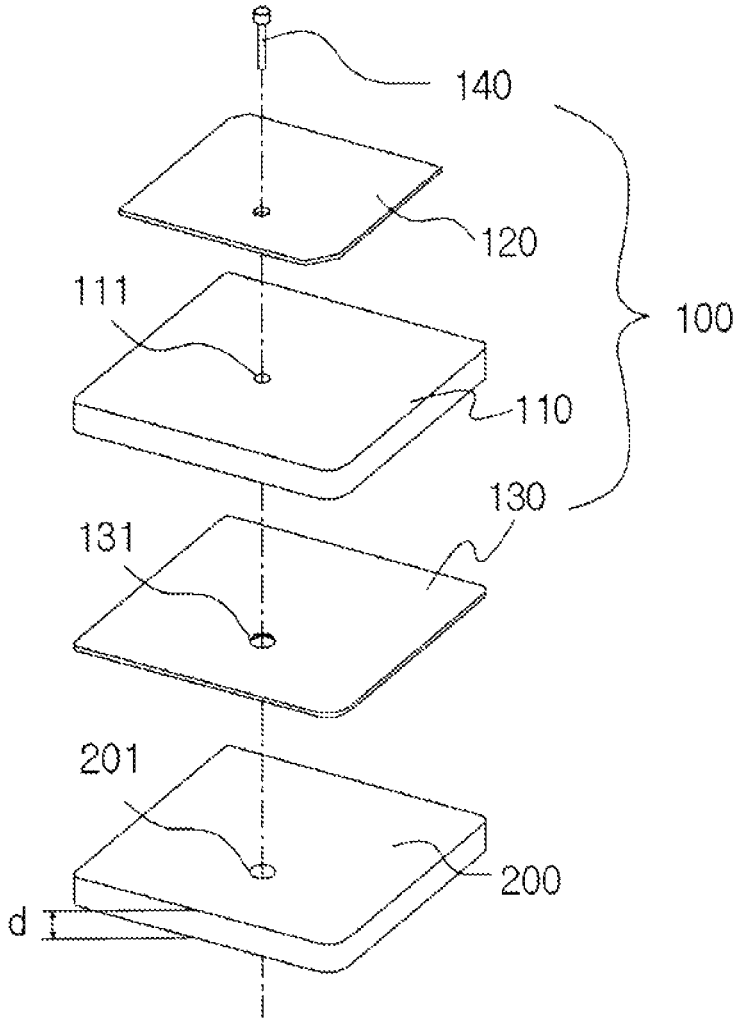
FIG. 4 is an exploded perspective view showing a circularly polarized ceramic patch antenna having an extended ground for a vehicle according to an embodiment of the present invention.

FIG. 4 is an exploded perspective view showing a circularly polarized ceramic patch antenna having an extended ground for a vehicle according to an embodiment of the present invention.

The circularly polarized ceramic patch antenna having an extended ground for a vehicle according to an embodiment of the present invention will be described below in greater detail with reference to FIG. 4.

As shown in FIG. 4, the circularly polarized ceramic patch antenna having an extended ground for a vehicle according to an embodiment of the present invention is disposed on a board having a feeder circuit and a ground plane, and includes: a patch antenna 100 having a dielectric 110 through which a first feeder hole 111 is bored and which is formed of ceramic, a radiator 120 that is formed of a quadrilateral metal thin film, diagonally opposite corners of which are partly chamfered to provide circular polarization, and that is formed on the dielectric 110, a main ground 130 through which a second feeder hole 131 is bored at a position corresponding to the first feeder hole 111 so as to be greater in diameter than the feeder hole 111 and which is formed of a metal thin film under the dielectric 110, and a feeder 140 that connects the radiator 120 and the feeder circuit on the board through the first and second feeder holes 111 and 131; and an extended ground 200 through which a third feeder hole 201 is bored so as to correspond to the second feeder hole 131, which has a predetermined thickness, which is placed under the patch antenna 100, which is formed of a metal conductor having the same shape as the patch antenna 100, and which is electrically connected to the ground plane formed on the board.

In detail, the radiator 120 of the patch antenna in the embodiment of the present invention operates at a digital satellite radio frequency band between 2.332 GHz and 2.345 GHz. The circular polarization formed at the radiator 120 of the patch antenna 100 is preferably left hand circular polarization (LHCP) suitable for the reception of digital satellite radio broadcasting in North America.

Further, the dielectric 110 of the patch antenna in the embodiment of the present invention is formed of a ceramic having a permittivity of 15 and a height of 4 mm. The dielectric 110 may be formed of one of various ceramics having a permittivity between 4.0 and 110.

Generally, the permittivity of ceramics covers a very wide range compared to materials used as conventional dielectrics, and the ceramics are very high in stability in terms of being able to resist changes in temperature, and are suitable for making the patch antenna lightweight and small.

The main ground 130 of the patch antenna in the embodiment of the present invention is provided across the entire bottom surface of the dielectric 110. The feeder 140 of the patch antenna 100 is formed as a rod-like pin, is inserted into the feeder holes 111 and 131 formed in the dielectric 110 and the main ground 130, and is electrically coupled with the radiator 120, so that a desired impedance characteristic can be properly changed by adjusting its position. Here, the diameter of the pin forming the feeder 140 corresponds to the diameter of the first feeder hole 111 formed in the dielectric 110.

Meanwhile, the circularly polarized ceramic patch antenna having an extended ground for a vehicle according to the embodiment of the present, invention can adjust the radiation efficiency of a specific frequency band at which the radiator 120 of the patch antenna 100 operates by adjusting the thickness d of the extended ground 200 formed under the patch antenna 100.

Further, because of a field effect generated between the radiator 120 of the patch antenna 100 and the ground plane formed on the board, the extended ground 200 is preferably formed so that the thickness thereof is between $0.03\lambda$ and $0.2\lambda$ of a clock frequency such that the directionality of a radiation pattern formed in a direction parallel to the ground plane is improved. The circularly polarized ceramic patch antenna having an extended ground for a vehicle according to the embodiment of the present invention reduces the null point by adjusting the thickness of the extended ground 200, so that the antenna gain thereof is increased by more than 1 dB.

Figure 5:
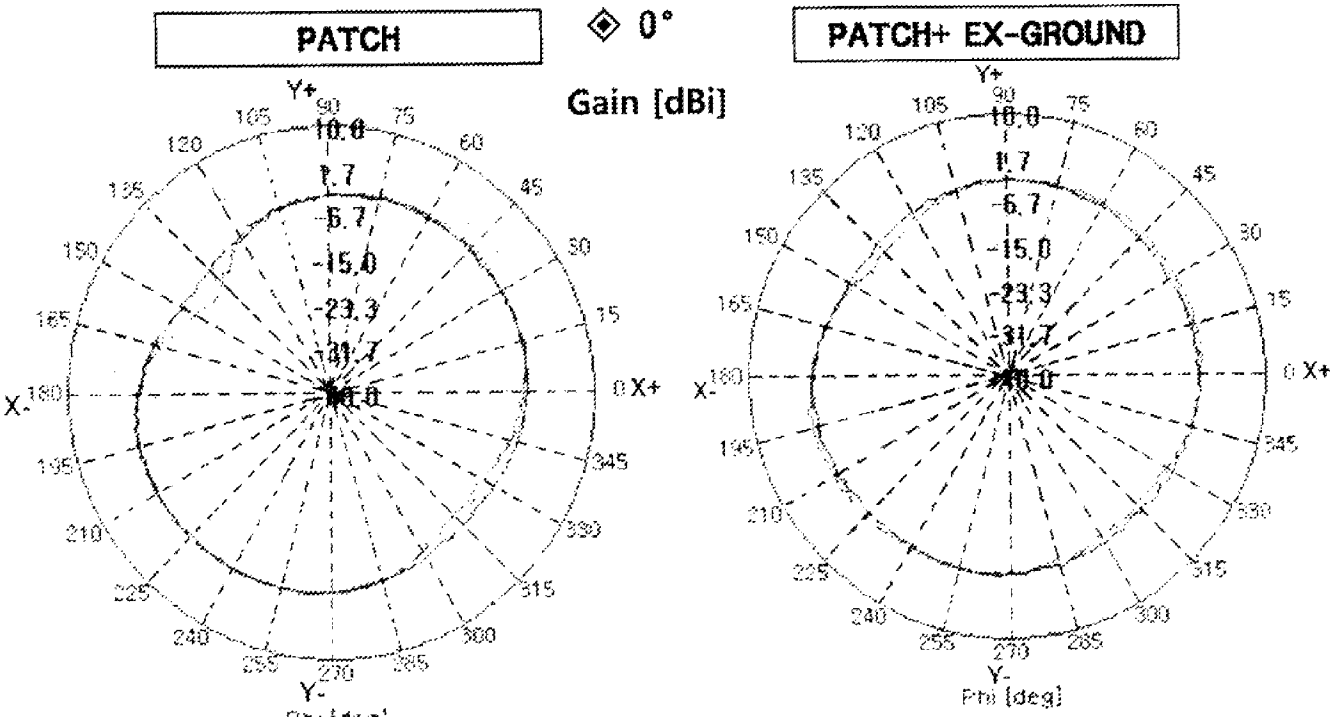
FIG. 5 is a graph showing the results of measuring and comparing antenna characteristics when an angle between a patch antenna and a ground plane is 0° before and after an embodiment of the present invention is applied.
Figure 6:
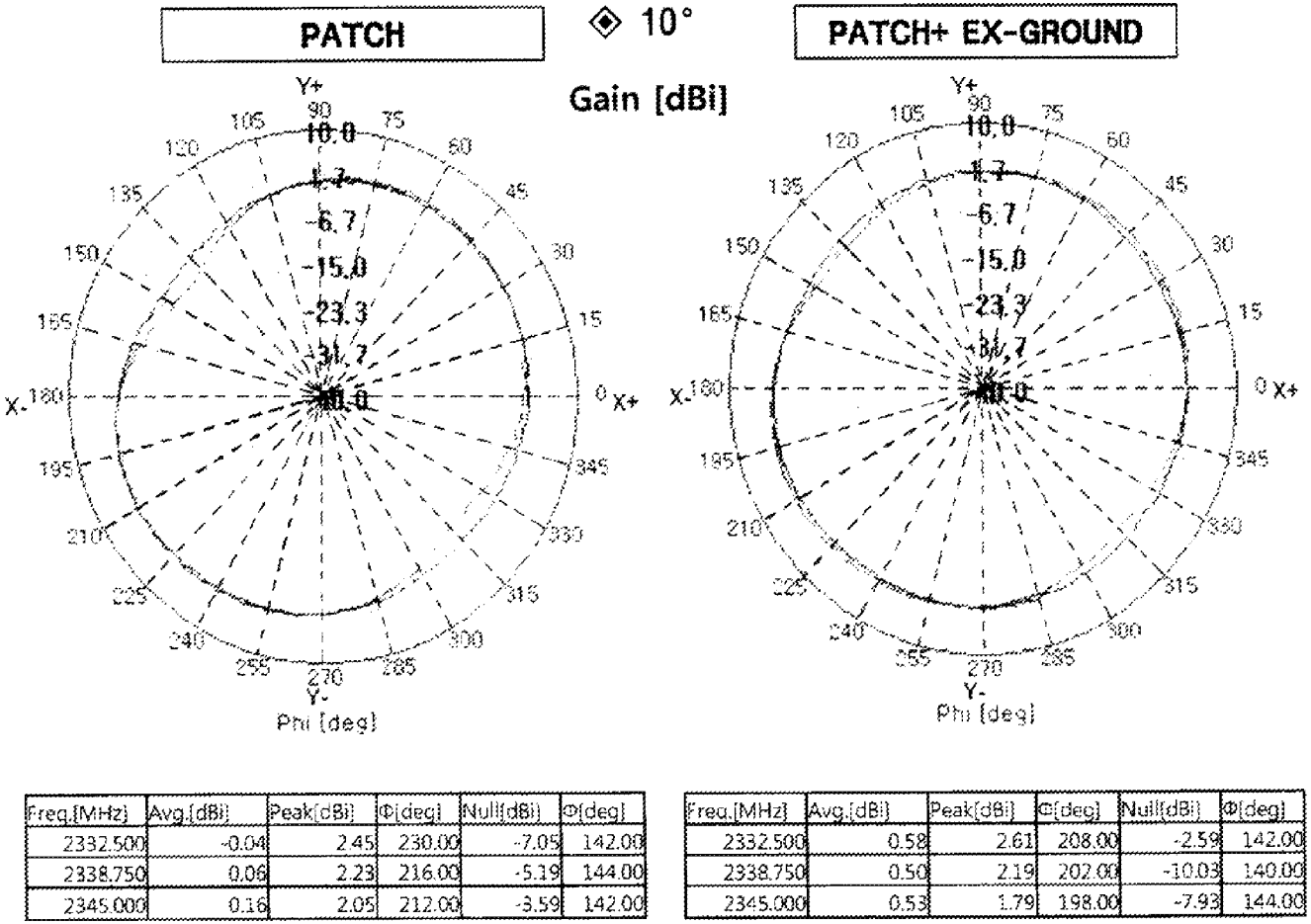
FIG. 6 is a graph showing results of measuring and comparing antenna characteristics when an angle between a patch antenna and a ground plane is 10° before and after an embodiment of the present invention is applied.

FIGS. 5 and 6 are graphs showing results of measuring and comparing antenna characteristics when an angle between a patch antenna and a ground plane is 0° and 10° in order to represent antenna radiation gains before and after an embodiment of the present invention is applied.

As shown in FIGS. 5 and 6, the circularly polarized ceramic patch antenna having an extended ground for a vehicle according to the embodiment of the present invention shows that an average of all radiation gain is improved by 0.5 dB compared to before applying the embodiment of the present invention. Consequently, it can be determined that the directionality of the antenna is improved in a direction parallel to the ground plane.

As described above, the present invention can adjust the radiation efficiency of the ceramic patch antenna for a vehicle which operates at a specific frequency band by adjusting the predetermined thickness of the extended ground that is formed under the patch antenna. Also, the extended ground is formed of a metal conductor having the same shape as the patch antenna, and is electrically connected to the ground plane formed on the board. Thus, the present invention has the effect of improving the directionality of the radiation pattern formed in a direction parallel to the ground plane, and the effect of reducing the null point caused by the field effect so as to increase the antenna gain of the ceramic patch antenna for a vehicle.

While the embodiment of the present invention has been described for illustrative purposes, it is apparent to those skilled in the art that various modifications, additions and substitutions are possible, without departing from the scope and spirit of the invention as disclosed in the accompanying claims.

What is claimed is:

1. A circularly polarized ceramic patch antenna having an extended ground for a vehicle, which is disposed on a board having a feeder circuit and a ground plane of a vehicle antenna, comprising:

the patch antenna having a dielectric through which a first feeder hole is bored and which is formed of a ceramic, a radiator that is formed of a quadrilateral metal thin film, diagonally opposite corners of which are partly chamfered for circular polarization, and that is formed on the dielectric, a main ground through which a second feeder hole is bored at a position corresponding to the first feeder hole so as to be greater in diameter than the first feeder hole and which is formed of a metal thin film placed under the dielectric, and a feeder that connects the radiator and the feeder circuit on the board through the first and second feeder holes; and the extended ground, through which a third feeder hole is bored so as to correspond to the second feeder hole, which is formed under the patch antenna, which has a predetermined thickness, which is formed of a metal conductor having a shape which is the same as a shape of the patch antenna, and which is electrically connected to the ground plane formed on the board.

2. The circularly polarized ceramic patch antenna according to claim 1, wherein the thickness of the extended ground formed under the patch antenna is adjusted to change a radiation efficiency of a specific frequency band at which the radiator of the patch antenna operates.

3. The circularly polarized ceramic patch antenna according to claim 2, wherein the radiator of the patch antenna has a circular polarization formed as left hand circular polarization (LHCP).

4. The circularly polarized ceramic patch antenna according to claim 2, wherein the thickness of the extended ground is formed to be between 0.03λ and 0.2λ of a frequency such that directionality of a radiation pattern formed in a direction parallel to the ground plane is improved, because of a field effect generated between the radiator 120 of the patch antenna 100 and the ground plane formed on the board.

5. The circularly polarized ceramic patch antenna according to claim 4, wherein the radiator of the patch antenna has a circular polarization formed as left hand circular polarization (LHCP).

6. The circularly polarized ceramic patch antenna according to claim 4, wherein the thickness of the extended ground is adjusted to reduce a null point to increase an antenna gain thereof up to 1 dB or more.

7. The circularly polarized ceramic patch antenna according to claim 6, wherein the radiator of the patch antenna has a circular polarization formed as left hand circular polarization (LHCP).

8. The circularly polarized ceramic patch antenna according to claim 6, wherein the radiator of the patch antenna operates at a digital satellite radio frequency band between 2.332 GHz and 2.345 GHz.

9. The circularly polarized ceramic patch antenna according to claim 8, wherein the radiator of the patch antenna has a circular polarization formed as left hand circular polarization (LHCP).

10. The circularly polarized ceramic patch antenna according to claim 1, wherein the radiator of the patch antenna has a circular polarization formed as left hand circular polarization (LHCP).

* * * * *